United States Patent [19]

Gross

[11] Patent Number: 4,671,080

[45] Date of Patent: Jun. 9, 1987

[54] CLOSED CRYOGENIC COOLING SYSTEM WITHOUT MOVING PARTS

[75] Inventor: Sidney Gross, Seattle, Wash.

[73] Assignee: The Boeing Company, Seattle, Wash.

[21] Appl. No.: 818,045

[22] Filed: Jan. 13, 1986

[51] Int. Cl.[4] ..... F25B 1/00

[52] U.S. Cl. ..... 62/467; 62/514 R; 417/48

[58] Field of Search ..... 62/467, 514 R; 417/48; 204/98

[56] References Cited

U.S. PATENT DOCUMENTS

| | | | |
|---|---|---|---|
| 3,415,077 | 12/1968 | Collins | 62/467 |
| 3,475,302 | 10/1969 | Langer et al. | 204/129 |
| 3,489,670 | 1/1970 | Maget | 204/129 |
| 3,586,435 | 6/1971 | Del Carlo et al. | 350/7 |
| 3,670,500 | 6/1972 | Schultz | 417/48 |
| 3,764,266 | 10/1973 | Murakami | 417/48 |
| 3,870,616 | 3/1975 | Dempsey et al. | 204/230 |
| 3,981,745 | 9/1976 | Stedman | 204/266 |
| 4,118,299 | 10/1978 | Maget | 204/180 |
| 4,250,013 | 2/1981 | Carlin | 204/282 |
| 4,253,922 | 3/1981 | Welch | 204/98 |
| 4,280,883 | 7/1981 | Raetzsch | 204/98 |
| 4,402,817 | 9/1983 | Maget | 204/301 |
| 4,593,534 | 6/1986 | Bloomfield | 62/467 |

OTHER PUBLICATIONS

Lerner et al., Cryogenics, pp. 548–550, Sep. 1975.

AIAA Paper No. 84–0058, J. A. Jones & P. M. Golben, Life Test Results of Hydride Compressors for Cryogenic Refrigerators, 1984.

AIAA Paper No. 84–0830, G. A. Klein & J. A. Jones, Molecular Absorption Cryogenic Cooler for Liquid Hydrogen Propulsion Systems, 1982.

NASA Tech Brief, Vol. 9, No. 4, Item #4, from JPL Invention Report NPO-16393/5865, J. A. Jones, Hydrogen Refrigerator Would Cool Below 10k, pp. i, 1–4, Nov. 1985.

Sedlak et al., Hydrogen Recovery and Purification Using the Solid Polymer Electrolyte Electrolysis Cell, Int. J. Hydrogen Energy, 6:45–51, 1981.

*Primary Examiner*—Ronald C. Capossela

*Attorney, Agent, or Firm*—Christensen, O'Connor, Johnson & Kindness

[57] ABSTRACT

The system generally includes an electrochemical pump for pressurizing a cryogenic gas, a heat exchanger for cooling the gas to below its inversion temperature, a Joule-Thomson flow restrictor to cool the gas by adiabatic expansion, a load heat exchanger that is thermally coupled to an electronic component or surface that requires cryogenic cooling, and a low-pressure flow path back to the pump. One or more reservoirs can be provided in the high-pressure and low-pressure flow paths. The flow paths can be thermally coupled by one or more regenerative heat exchangers. The electrochemical pump can be adapted to transport either protons or hydronium ions. Protons are preferably transported using pump components that do not contain water in any chemical form. Either hydrogen or oxygen can serve as the cryogen. Where hydrogen is the cryogen, the high-pressure flow path can be provided with a catalytic surface to convert ortho-hydrogen to para-hydrogen, and the low-pressure flow path can bear a catalyst to promote the reverse reaction.

28 Claims, 5 Drawing Figures

JOULE - THOMPSON COOLING WITH HYDROGEN

CLOSED CRYOGENIC COOLING SYSTEM WITHOUT MOVING PARTS

FIELD OF THE INVENTION

This invention relates to closed systems for providing cryogenic cooling to electronic components such as space-based surveillance sensors.

BACKGROUND OF THE INVENTION

Various electronic devices and systems are designed to operate at cryogenic temperatures, well below liquid nitrogen temperatures. Infrared sensors, demagnetization devices, infrared interferometers, cryogenic optics and filters, and low noise cryogenic electronic devices are representative electronic components that require cooling at cryogenic temperatures. For applications of short duration, cryogenic dewars are useful for providing cryogenic cooling to such electronic components and other devices. However, a closed loop refrigeration system is required for applications that must be conducted intermittently or continuously over a long period of time, such as certain spacecraft experiments, interplanetary missions, and processing and manufacturing in space.

Closed cryogenic cooling systems typically employ a Joule-Thomson flow restrictor to reduce the temperature of a cryogen such as hydrogen, helium, nitrogen, oxygen, air, or methane. The cryogenic gas is typically compressed and then cooled to well below its inversion temperature in a regenerative heat exchanger prior to being adiabatically expanded through the Joule-Thomson flow restrictor. The expansion can be made to liquify part of the gas. The expanded gas is recirculated in a closed loop through a compressor of conventional design. See U.S. Pat. No. 3,415,077; U.K. Pat. No. 1,433,727; Lerner, E., et al., Cryogenics, pp. 548–550, September 1975. Mechanical compressors are considered unreliable for long-term and intermittent applications, making them unsuitable for spacecraft applications. A cryogenic refrigeration system with no moving parts would enhance the operating lifetime and reliability of cryogenically cooled electronic components sent into deep space and other environments where maintenance is impossible or impractical. Recently, molecular absorption compressors have been incorporated into closed cryogenic cooling systems containing only a few moving parts, but the metal halide pumps must be staged to achieve the compression and in addition require sophisticated feedback control. See AIAA Papers Nos. 82-0830 and 84-0058.

Electrochemical pumps, described for example in U.S. Pat. Nos 3,489,670 and 4,118,299, typically compress hydrogen by transporting hydrogen ions across a solid polymer membrane containing water in some form.

SUMMARY OF THE INVENTION

A closed cryogenic cooling system with no moving parts includes an electrochemical pump for pressurizing an ionizable cryogenic gas such as hydrogen or oxygen. The electrochemical pump delivers a pressurized gas stream into a high-pressure flow path. Provision is made to remove any entrained water vapor. One or more heat exchangers are provided in the higher-pressure flow path for cooling the pure gas to below its inversion temperature prior to delivery through a Joule-Thomson flow restrictor into a load heat exchanger that is thermally coupled to an electronic component or surface that requires cryogenic cooling. A low-pressure flow path shuttles the expanded gas from the load heat exchanger to the electrochemical pump. One or more heat exchangers are provided in the low-pressure flow path to warm the gas to a predetermined temperature which is optimum for operation of the electrochemical pump. Accumulators can be provided in the high-pressure and low-pressure flow paths. The flow paths can be thermally coupled by one or more regenerative heat exchangers. The electrochemical pump can be adapted to transport either hydronium ions or protons. Protons are preferably transported using pump components that do not contain water, ammonia or other materials in any chemical form which could enter and contaminate the gas. Where hydrogen is the cryogen, the high-pressure flow path can be provided with a catalytic surface to convert ortho- to para-hydrogen, and the low-pressure flow path can bear catalysts to promote the para- to ortho-conversion. The system is simple, compact, and has unlimited lifetime potential.

DETAILED DESCRIPTION OF THE PREFERRED EMBODIMENT

Figure 1:
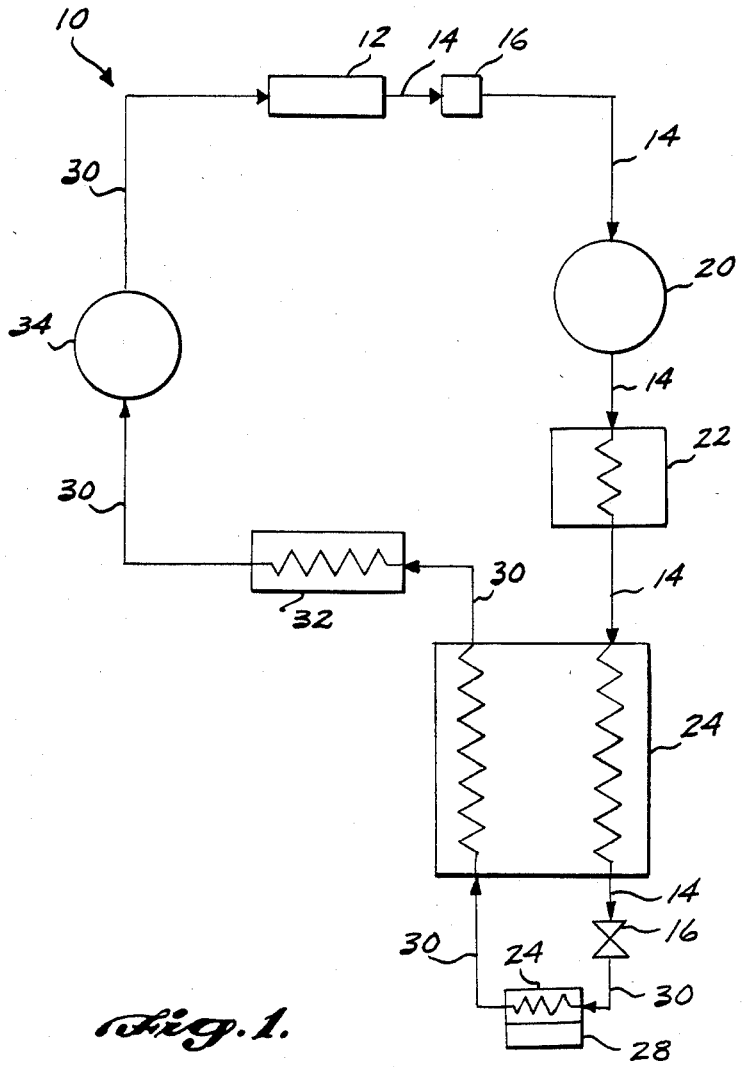
FIG. 1 is a schematic diagram of an embodiment of the invention.

Referring to FIG. 1, in an exemplary closed cryogenic cooling system 10 an electrochemical pump 12 compresses an ionizable cryogenic gas into a high-pressure gas inflow path 14 upstream from a Joule-Thomson flow restrictor 16. An ionizable cryogenic gas is a gas, such as hydrogen or oxygen, that liquifies at less than about 110° K. at atmospheric pressure and that has an ionic form. Any entrained water vapor must be separated from the pressurized gas in a desiccator 18 having, for example, a palladium-silver hydrogen diffusion membrane. The high-pressure gas stream may be routed through an accumulator or other reservoir 20 before passing through a first auxiliary heat exchanger 22 where the gas is cooled to well below its inversion temperature, i.e., the temperature at which the Joule-Thomson coefficient of the pressurized gas changes sign. This top stage cooling, e.g, to 160° K. or less for hydrogen at 12 MPa pressure, can be accomplished by radiation to free space from a spacecraft. The precooled gas then passes through the high-pressure side of a regenerative heat exchanger 24 for further cooling before adiabatically expanding through the Joule-Thomson flow restrictor 16, resulting in further cooling. The Joule-Thomson flow restrictor 16 is a valve or orifice(s) through which the gas stream is allowed to adiabatically expand. For spacecraft applications the flow restrictor 16 can be a metal foam or porous sinter having a plurality of parallel-path orifices to avoid single point failure. The throttling can liquify a portion of the gas.

The adiabatically expanded gas provides cryogenic cooling in a load heat exchanger 26 that is thermally coupled to a cryogenic surface or device such as an electronic component 28. A low-pressure gas flow path 30 delivers the expanded gas from the load heat exchanger 24 to the electrochemical pump 12. Flow path 30 incorporates the low-pressure side of the regenerative heat exchanger 24, so that the cold low-pressure gas cools the pressurized gas prior to entry of the low-pressure gas into a second auxiliary heat exchanger 32, where the low-pressure gas is heated. The warmed low-pressure gas is delivered on demand to the electrochemical pump 12. To accommodate transient operating conditions such as pressure surges, a reservoir or accumulator 34 can also be provided in the low-pressure flow path 30. The closed system 10 can be static sealed, i.e., using welded, gasketless seals, to minimize leakage of the cryogen during prolonged missions.

Figure 2:
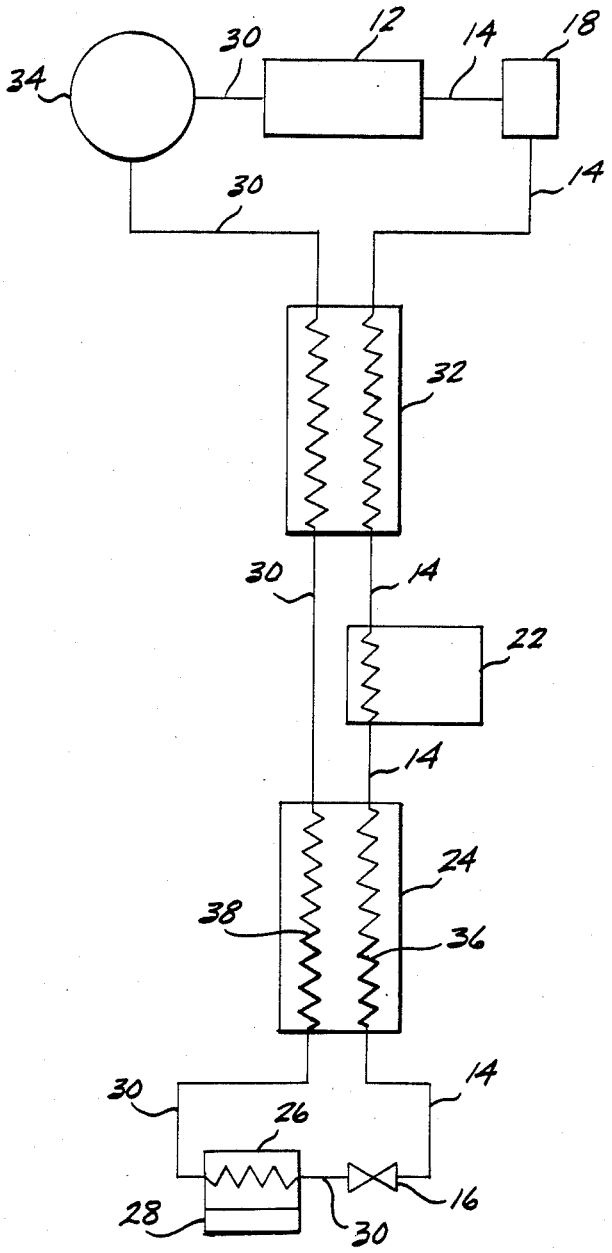
FIG. 2 is a schematic diagram of another embodiment of the invention.

Referring to FIG. 2, the warming function of the second auxiliary heat exchanger 32 can be realized by thermally coupling the low-pressure flow path 30 with the high-pressure flow path 14 upstream of the first auxiliary heat exchanger 22. Waste heat from other mission components can alternatively provide or supplement this warming function. The low-pressure gas stream must be warmed to above the freezing point of water if water-bearing membranes are employed in the electrochemical pump 12; otherwise, the gas is warmed to the optimum operating temperature of the pump's ionic conductor.

The ortho-para relationships of hydrogen should be considered when hydrogen is employed as the cryogen. At ambient temperature the ortho form of hydrogen gas prevails under steady state, while para-hydrogen predominates at liquid hydrogen temperatures. Unless the conversion of ortho to para is catalyzed during cool-down of the gas within the high-pressure flow path 14, spontaneous conversion can take place at or near the Joule-Thomson flow restrictor 16, resulting in a reduction of cooling capacity. Conversely, during the warming of the gas within the low-pressure flow path 30 it is advantageous to catalyze the conversion of para to ortho for an efficient process. The catalysts 36, 38 are incorporated onto gas-contacting surfaces of the flow paths 14, 30, preferably in the high-pressure and low-pressure sides of the regenerative heat exchanger 24.

Suitable catalysts 36, 38 for promoting the conversion of ortho-to para-hydrogen include iron oxide catalysts (as described, for example, in Japan Kokai Tokkyo Koho No. JP 7359090, 8/18/73), rhodium phosphine complexes (Brown, J. M., et al., J. Organomet. Chem. 255(1): 103—111, 1983), certain Group IV–VI transition metal nitrides (Kharlamov, A. I., et al., Tugoplavkie Nitridy, pp. 62–65, 1983), samarium copper (Boeva, O. A., et al., Kinet. Katal. 24(3): 629–632, 1983), potassium-triphenylene complex (Enoki, T., et al., Mol. Cryst. Liq. Cryst. 96(1–4): 401–411, 1983), titanium and manganese carbides (Kharlamov, A. I., et al., Fiz.-khim. Svoistva Tugoplavk. Soedin, i Splavov, Kiev, pp. 55–58, 1981), chromia-alumina and molybdenum-alumina (Kauffman, D., et al., J. Catal. 71(2): 244–256, 1981), sodium hydride (Chappell, M. J., et al., J. Res. Inst. Catal., Hokkaido Univ. 28(3): 109–117, 1980), certain d-metal borides (Kharlamov, A. I., Kinet. Katal. 22(3): 684–689, 1981), chromium potassium sulfate (Sakurai, H., Jpn. J. Appl. Phys. 17(6): 1141–1142, 1978), copper-nickel, and cobalt zeolite.

Figure 3:
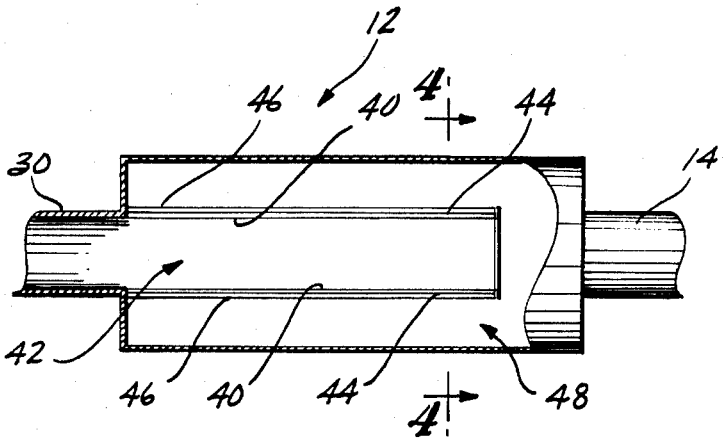
FIG. 3 is a detailed section taken along section lines 3—3 in FIG. 1.
Figure 4:
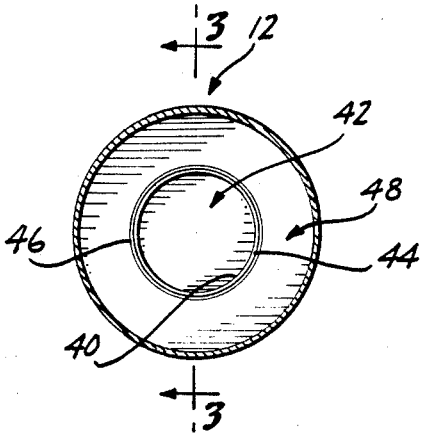
FIG. 4 is a detailed section taken along section lines 4—4 in FIG. 3; and, FIG. 5 is a graph illustrating how the degree of precooling and heat exchanger effectiveness interact with the pressure rating of the electrochemical pump to define operating regions of particular systems.

Referring to FIGS. 3 and 4, the electrochemical pump 12 can be designed with coaxially disposed elements and have a tubular shape. Alternatively the elements described below can be arranged in planar, concentric, or honeycomb stack configurations. A first catalytically active current collector 40, having gas-contacting surfaces disposed in the delivery end 42 of the low-pressure flow path 30, is associated on the downstream side through an ionic conductor 44 with a second catalytically active current collector 46 having gas-contacting surfaces disposed in the receiving end 48 of the high-pressure flow path 14. Structural support elements (not shown) are incorporated into the low-pressure side to support the ionic conductor 44 against the high-pressure gas. If the ionic conductor 44 is a membrane, the first catalytically active current collector 40 should be strong enough to bear the compressive load and should have pores sufficiently small to support the membrane 44 without damage.

As described in U.S. Pat. Nos. 3,475,302, 3,489,670, and 4,118,299 (all incorporated by reference), the pump 12 transports hydrogen by:

(1) converting hydrogen gas to hydrogen ions, either protons (H+) or hydronium ions ($H_3O^+$), using a catalyst at the first current collector 40;

(2) transporting the hydrogen ions through the ionic conductor 44, using an electrical potential applied between the current collectors 40, 46; and, (3) reconverting the transported hydrogen ions to hydrogen gas using a catalyst at the second current collector 46.

For electrochemical pumps 12 employing hydronium ion conductors 44 the above steps include the conversion of hydrogen gas to hydronium ions:

$$H_2+2H_2O \rightarrow 2e^- + 2H_3O^+$$

catalyzed by, e.g., platinum at an anode that serves as the first current collector 40; and conversion of transported hydronium ions to hydrogen gas:

$$2H_3O^+ + 2e^- \rightarrow H_2 + 2H_2O$$

catalyzed by, e.g., platinum at a cathode 42 at the high-pressure side of the pump 12. The water byproduct must be removed from the high-pressure gas stream or the Joule-Thomson flow restrictor 16 will freeze shut. Complete separation of water vapor from hydrogen gas can be accomplished by diffusion through a palladium-silver alloy (75:25 wt%; Platin. Metals Rev. 7: 126, 1963) disposed at or near the receiving end 48 of the high-pressure flow path 14. The separated water may be stored or returned to the ionic conductor 44 by active or passive means. A system 10 that incorporates a water-bearing ionic conductor 44 also requires heating of the low-pressure gas stream to above the freezing point of water, necessitating an energy consumption that may adversely affect the overall efficiency of the system 10 and other mission components. Water-bearing ionic conductors include solid, hydrated membranes and other materials in which water molecules are absorbed or chemically combined, as well as wetted materials containing water in solution.

An electrochemical hydronium ion pump may contain a platinum catalyst on both sides of a NAFION membrane (#117 or 125; Du Pont). The catalyst-coated membrane is sandwiched between and in mutual contact with a pair of porous, sintered plates such as niobium that serve as the anode and cathode. The pores in these current collectors are sized just large enough to permit unrestricted passage of hydrogen or oxygen gas molecules. The membrane can alternatively be sandwiched between platinum-coated sides of porous carbon paper or cloth, with structural support provided by fine-mesh niobium screens, porous ceramic, plastic, or other inert material. Wetted conductors such as asbestos saturated with potassium hydroxide solution may be used in conjunction with catalytically active current collectors, e.g., platinum/teflon/carbon paper or platinum-coated palladium-silver alloy, that contain the water within the ionic conductor. The vapor barrier should be incorporated into at least the downstream side of the pump.

For electrochemical pumps 12 employing hydrogen ion (proton) conductors 44 the foregoing conversion steps include dissociation of hydrogen gas to protons and electrons:

$$H_2 \rightarrow 2e^- + 2H^+$$

catalyzed by, e.g., platinum at an anode 40; and conversion of transported protons to hydrogen gas:

$$2H^+ + 2e^- \rightarrow H_2$$

catalyzed by, e.g., platinum at a cathode 42. The provision of hydrogen ion (proton) conductors 44 that contain no water, e.g., proton conducting fluoride glasses, hydrogen-beta-alumina, $HTaWO_6$ and $KTaO_3$ ceramics, eliminates the need for water management in the system 10. Such proton conductors can also be made very thin, on the order of 15 microns or less, to compensate for their relatively low conductivity. Suitable proton conductors, some of which contain no water, are listed in TABLE III, R. A. Huggins, Solid Electrolytes, in Materials for Advanced Batteries, D. W. Murphy, et al., eds., Plenum Press, N.Y., pp. 91–110, 1979. Proton-conducting halide glasses that are considered likely candidates for the subject water-less systems are disclosed by Schroder, J., Angew. Chem., internat. ed. 3: 376, 1964. Proton conducting complex metal oxides, e.g., $HTaWO_6$, are disclosed in Physics Rev., B-19, 54–55, 1979. Other proton conductors are disclosed in: J. Am. Chem. Soc. 65(5): C71, 1982; Z. Phys. Chem. (Wiesbaden) 110(2): 285–288, 1978; Amorphous Liq. Semicond., Proc. Int'l. Conf., 5th, Vol. 2, pp. 1173–1177, Stuke, J., ed., Taylor and Francis, London, 1973; J. Non-Cryst. Solids 15(2): 191–198, 1974; J. Non-Cryst. Solids 51(3): 357–365, 1982; Shilton, M. G., et al., in Fast Ion Transport in Solids: Electrodes and Electrolytes, Vashishta, P., et al., eds., Elsevier North Holland, N.Y., pp. 727–730, 1979; Z. Phys. Chem. (Wiesbaden) 110(2): 285–288, 1978; J. Applied Physics 42(8): 3121–3124, 1971; J. Polymer Science: Polymer Chemistry Ed. 10(11): 3447–3450, 1972; Annual technical report June 1, '73–May 31, '74, and Semiannual techincal report June 1,–Nov. 30, 1973, Contract No: DAHC-15-73-G11; ARPA Order-2338; U.S. Pat. No. 4,513,069; Wiseman, P. J., Particle hydrates as proton conductors, in Progress in Solid Electrolytes, Wheat, T. A., et al., eds., CANMET, Canada, pp. 199–202, 1983; all incorporated by reference.

In an exemplary proton pump a 15-micron layer of conducting fluoride glass or $NH_4TaWO_6$ ceramic (Specht, R., D. Brunner & G. Tominol, Proton-conducting ceramic, in Amer. Ceramic Soc. 87th Annual Mtg., Abs. 87-E-85, May 1985) is coated on both sides with platinum catalyst and sandwiched between patterned niobium or gold current collectors applied to porous ceramic supports.

Figure 5:
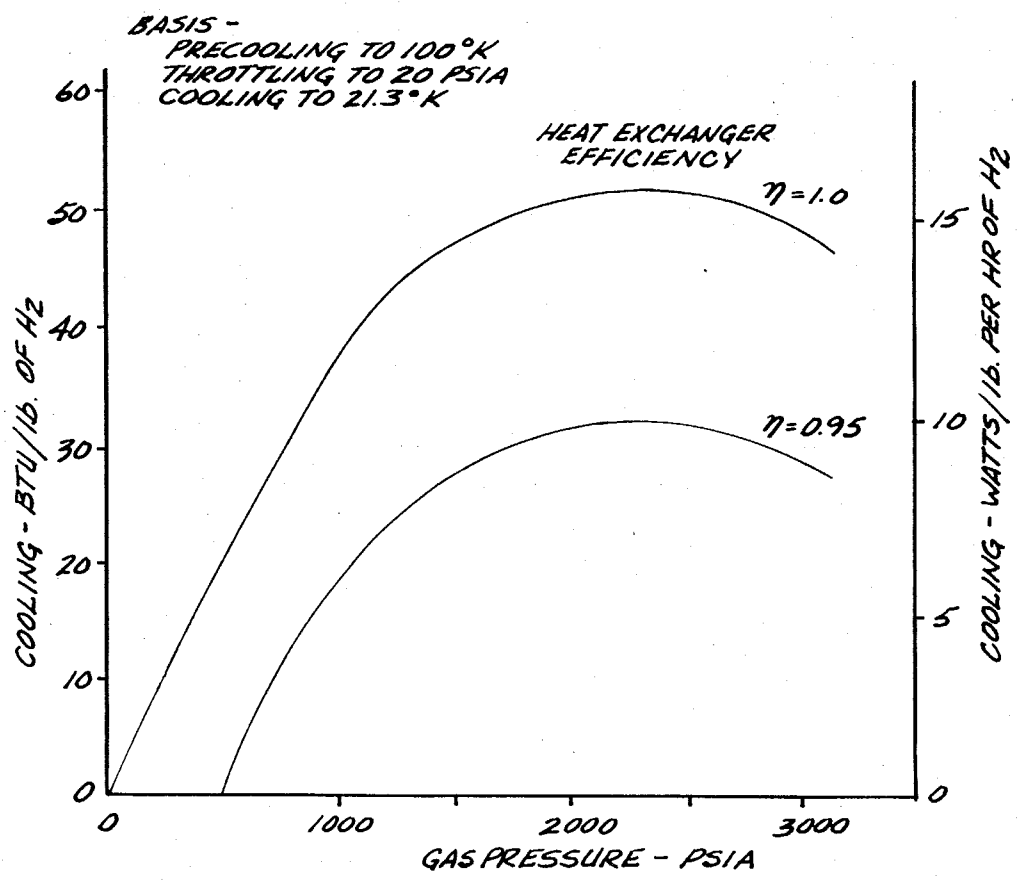

The maximum amount of cooling obtained per pound of hydrogen circulated through the system 10 is senitive to both the degree of precooling and the heat exchanger efficiency. FIG. 5 presents the results of a typical thermodynamic calculation showing that up to 55 BTU/lb of $H_2$ (128.0 kJ/kg) is obtainable using precooling to 100° K. The optimum pressure for minimum hydrogen flow under ideal conditions is approximately 2400 psia (16.5 MPa). However, this is not necessarily the engineering optimum pressure for minimum weight or minimum energy consumption, especially under non-ideal conditions considering losses and inefficiencies. For example, operating at such a high pressure produces a small temperature rise during the Joule-Thomson expansion prior to the main cooling that is produced during expansion, and that could burden the design of the heat exchanger. Thus, lower operating pressures in the range of about 1500 to about 1900 psia (10.3 to 13.1 MPa) may be preferable for systems 10 with imperfect heat exchangers and diffusion losses. Overall performance is shown in FIG. 5 to be very sensitive to heat exchanger effectiveness, with preference for heat exchangers having efficiencies of at least 95%. In a preferred embodiment the heat exchangers in the system have effectiveness on the order of 98–99%.

In a representative system 10 employing a hydronium ion pump with a solid electrolyte membrane, hydrogen gas is pressurized to about 7–14 MPa, preferably to 12 MPa, before top stage cooling to about 70°–100° K., preferably to 70° K. The pressurized gas is further cooled to about 14°–30° K., preferably to 20° K., in a regenerative heat exchanger having an effectiveness on the order of 99% before throttling to about 0.01–1.2 MPa. The expanded gas stream is warmed to about 290°–360° K., preferably to 325° K., before entering an electrochemical pump having power requirements of about 100 $W_{electric}/W_{cooling}$. Hydrogen flow rate through the system is on the order of 5 mg/sec/watt $_{cooling}$. For intermittent use the system shown in FIG. 2 is started without applying a load in the load heat exchanger and with a small mass flow rate such that the top stage cooling in the first auxiliary heat exchanger is sufficient to bring the gas below the inversion temperature. The mass flow rate is increased as the low-pressure sides of the heat exchangers become primed with cold gas.

In a related embodiment a closed cycle cryogenic cooling system operating on oxygen provides cooling to 94° K. without the use of moving parts. The oxygen system is similar to the system 10 shown in FIG. 2, except that provision need not be made for the ortho-/para-hydrogen conversion catalysts. Also, the need for precooling by the first auxiliary heat exchanger is considerably reduced with an oxyen cryogen, since the inversion temperature may be in excess of room temperature.

An electrochemical pump for oxygen can employ an ionic conductor 44 that transports either oxygen ions or hydronium ions. For example, $Bi_2O_3$ is good oxygen conductor operating at room temperature; $(Bi_2O_3)_{0.6}(PbO)_{0.25}(CaO)_{0.15}$ is a suitable oxygen ion solid electrolyte. Yttria-doped zirconia is suitable for conducting oxygen ions at higher temperatures in conjunction with praseodymium oxide catalysts. Other oxygen conductors include the cathode materials disclosed at pages 15–17 of CANMET Division Report ERP/MQL 83–120 (IR), August 1983, and at pages 281–285 of Subbarao, E. C., et al., Oxide electrolytes with fluoride structure, in Progress in Solid Electrolytes, Wheat, T. A., et al., eds., CANMET, Canada, pp. 283–285, 1983; both incorporated by reference.

The maximum amount of cooling obtained per pound of oxygen circulated through the system is sensitive to the degree of precooling and the heat exchanger efficiency. For example, with a typical operating pressure of 2000 psia (13.8 MPa), the theoretical cooling available without precooling (21° C. operation) is 12 BTU/lb (27.9 kJ/kg) of $O_2$; precooling to −40° C. (233° K.) doubles the amount of cooling available.

While preferred embodiments of the invention have been described, one of ordinary skill after reading the foregoing specification will be able to effect various changes, substitutions of equivalents, and other alterations to the system and method set forth herein. The description is intended to illustrate the invention and is not meant to limit it, unless such limitation is necessary to avoid the pertinent prior art. Therefore, the protection granted by Letters Patent should be limited only by the definition contained in the appended claims and equivalents thereof.

The embodiments of the invention in which an exclusive property or privilege is claimed are defined as follows:

1. A closed system with no moving parts for providing cryogenic cooling to a load heat exchanger, comprising:

(a) an electrochemical pump for pressurizing an ionizable cryogenic gas;

(b) a high-pressure flow path adapted to direct pressurized gas from the electrochemical pump to the load heat exchanger, the path including a first heat exchanger for cooling the gas to below its inversion temperature and a Joule-Thomson flow restrictor to further cool the gas to a cryogenic temperature for delivery to the load heat exchanger; and, (c) a low-pressure flow path adapted to receive the gas from the load heat exchanger and to return the gas to the electrochemical pump, the low-pressure flow path including a second heat exchanger for warming the gas to a predetermined temperature.

2. The system of claim 1 wherein the load heat exchanger is adapted to provide cryogenic cooling to an electronic component.

3. The system of claim 1 wherein the ionizable cryogenic gas is selected from the group consisting of hydrogen and oxygen.

4. The system of claim 3 wherein the ionizable cryogenic gas is hydrogen.

5. The system of claim 4 further comprising first and second catalyst means, the first catlyst means incorporated into the high-pressure flow path to convert ortho-hydrogen to para-hydrogen, and the second catalyst means incorporated into the low-pressure flow path to convert para-hydrogen to ortho-hydrogen.

6. The system of claim 5 wherein the first and second catalyst means comprise one or more catalysts selected from the group consisting of iron oxide catalysts, rhodium phosphine complexes, Group IV–VI transition metal nitrides, samarium copper, potassium-triphenylene complex, titanium carbide, manganese carbide, chromia-alumina, molybdenum-alumina, sodium hydride, d-metal borides, chromium potassium sulfate, copper nickel, and cobalt zeolite.

7. The system of claim 1 further comprising a gas reservoir incorporated into the high-pressure flow path.

8. The system of claim 1 further comprising a reservoir incorporated into the low-pressure flow path.

9. The system of claim 1 further comprising a regenerative heat exchanger thermally coupling the receiving end of the low-pressure flow path and the delivery end of the high-pressure flow path.

10. The system of claim 1 wherein the second heat exchanger is thermally coupled to the high-pressure flow path upstream of the first auxiliary heat exchanger.

11. The system of claim 1 wherein the second heat exchanger warms the gas to above the freezing point of water.

12. The system of claim 1 further comprising desiccator means incorporated into the high-pressure flow path.

13. The system of claim 1 wherein the electrochemical pump comprises a hydronium ion conductor.

14. The system of claim 13 wherein the electrochemical pump comprises desiccator means.

15. The system of claim 1 wherein the electrochemical pump comprises a proton conductor.

16. The system of claim 15 wherein the electrochemical pump comprises desiccator means.

17. The system of claim 15 wherein the proton conductor is a solid, non-hydrated material.

18. The system of claim 17 wherein the proton conductor is selected from the group consisting of proton-conducting halide glasses, hydrogen-beta-alumina, $NH_4TaWO_6$, $HTaWO_6$, and $KTaO_3$.

19. A closed, static-scaled system with no moving parts for providing cooling at about 14°–30° K. to an electronic component, comprising:

(a) an electrochemical pump for pressurizing hydrogen gas to about 7–14 MPa;

(b) a high-pressure flow path adapted to direct pressurized gas from the electrochemical pump to a load heat exchanger adapted to provide cooling at about 14°–30° K. to the electronic component, the path including a first heat exchanger for cooling the gas to about 70°–100° K. and a Joule-Thomson flow restrictor for further cooling the gas to about 14°–30° K. for delivery to the load heat exchanger; and, (c) a low-pressure flow path adapted to receive the gas from the load heat exchanger and to return the gas to the electrochemical pump, the low-pressure flow path including a second heat exchanger for warming the gas to a predetermined temperature.

20. The system of claim 19 wherein the gas pressure after passing through the Joule-Thomson flow restrictor is about 0.01–1.2 MPa.

21. The system of claim 19 wherein the warming in the second heat exchanger is to about 290°–360° K.

22. The system of claim 21 wherein the electrochemical pump comprises a hydronium ion conductor.

23. The system of claim 22 wherein the electrochemical pump comprises desiccator means.

24. The system of claim 22 further comprising desiccator means in the high-pressure flow path.

25. The system of claim 19 wherein the hydrogen flow rate is on the order of 5 mg/sec/watt cooling.

26. The system of claim 19 wherein the power requirements of the electrochemical pump is on the order of 100 $W_{electric}/W_{cooling}$.

27. The system of claim 19 wherein the first heat exchanger is adapted to cool the pressurized gas by radiation to space.

28. The system of claim 19 wherein the Joule-Thomson flow restrictor comprises a plurality of orifices.

* * * * *

UNITED STATES PATENT AND TRADEMARK OFFICE

CERTIFICATE OF CORRECTION

PATENT NO. : 4,671,080

DATED : June 9, 1987

INVENTOR(S) : Sidney Gross and Devin Wayne Hersey

It is certified that error appears in the above-identified patent and that said Letters Patent is hereby corrected as shown below:

On the title page,

INVENTOR: Delete "," after "Seattle" and add --; Devin Wayne Hersey, Issaquah; both of--

Column 1, line 53: "Nos" should be --Nos.--

Column 7, line 55: "catlyst" should be --catalyst--

Signed and Sealed this

Twenty-fourth Day of November, 1987

*Attest:*

DONALD J. QUIGG

*Attesting Officer*

*Commissioner of Patents and Trademarks*